US009511907B2

(12) United States Patent
Erickson et al.

(10) Patent No.: US 9,511,907 B2
(45) Date of Patent: Dec. 6, 2016

(54) SPOUT ASSEMBLY FOR A FLEXIBLE BAG

(71) Applicant: Scholle Corporation, Irvine, CA (US)

(72) Inventors: Kyle Erickson, Chicago, IL (US); Chris Murray, Chicago, IL (US); David Bellmore, DeWitt, MI (US)

(73) Assignee: Scholle IPN Corporation, Northlake, IL (US)

( * ) Notice: Subject to any disclaimer, the term of this patent is extended or adjusted under 35 U.S.C. 154(b) by 351 days.

(21) Appl. No.: 14/327,820

(22) Filed: Jul. 10, 2014

(65) Prior Publication Data

US 2016/0009462 A1 Jan. 14, 2016

(51) Int. Cl.

| | |
|---|---|
| ***B65B 1/04*** | (2006.01) |
| ***B65D 47/12*** | (2006.01) |
| ***B65D 25/48*** | (2006.01) |
| ***B65D 75/58*** | (2006.01) |

(52) U.S. Cl.

CPC ..... *B65D 47/123* (2013.01); *B65D 25/48* (2013.01); *B65D 75/5877* (2013.01)

(58) Field of Classification Search

CPC B65D 25/48; B65D 47/123; B65D 75/5872; B65D 75/5877

See application file for complete search history.

(56) References Cited

U.S. PATENT DOCUMENTS

| | | | | |
|---|---|---|---|---|
| 2,286,263 | A | | 6/1942 | Comins |
| 3,168,969 | A | | 2/1965 | Krieps |
| 3,405,831 | A | | 10/1968 | Hudson |
| 3,454,196 | A | * | 7/1969 | Hazard ..... B65D 47/123 222/541.2 |
| 4,129,236 | A | | 12/1978 | Wrycraft et al. |
| 4,179,042 | A | | 12/1979 | Schuck |
| 4,286,636 | A | | 9/1981 | Credle |
| 4,445,539 | A | | 5/1984 | Credle |
| 4,445,551 | A | | 5/1984 | Bond et al. |
| 5,238,152 | A | | 8/1993 | Maas et al. |
| 5,255,713 | A | | 10/1993 | Scholle et al. |
| 5,445,186 | A | | 8/1995 | Richter et al. |
| 5,454,605 | A | | 10/1995 | Mott |
| 5,477,883 | A | | 12/1995 | Totten |
| 5,639,064 | A | | 6/1997 | deCler et al. |
| 5,983,964 | A | | 11/1999 | Zielinksi et al. |
| 6,170,543 | B1 | | 1/2001 | Simmel et al. |
| 6,347,785 | B1 | | 2/2002 | Copp et al. |

(Continued)

FOREIGN PATENT DOCUMENTS

| | | |
|---|---|---|
| CA | 2462500 A1 | 5/2003 |
| EP | 0502716 A2 | 3/1992 |

(Continued)

*Primary Examiner* — Jason K Niesz

(74) *Attorney, Agent, or Firm* — The Watson I.P. Group, PLC; Jovan N. Jovanovic; Vladan M. Vasiljevic

(57) ABSTRACT

A spout assembly for a flexible bag having a base flange, a body and a dual lead thread. The base flange has a top surface and a bottom surface. At least one of the top surface and the bottom surface are configured for coupling to a flexible bag. The body extends from the base flange and includes a proximal end corresponding to the base flange and a distal end spaced apart therefrom, and, an inner surface and an outer surface. The dual lead thread extends along the outer surface of the body between the proximal end and the distal end. The dual lead thread has a first threadform and a second threadform. The first threadform has a first threadform length. The second threadform has a second threadform length. The length of the first threadform is different than that of the second threadform.

20 Claims, 16 Drawing Sheets

(56) References Cited

U.S. PATENT DOCUMENTS

| | | | |
|---|---|---|---|
| 6,612,545 | B1 | 9/2003 | Rutter et al. |
| 6,637,725 | B2 | 10/2003 | Davis et al. |
| 6,702,337 | B2 | 3/2004 | Rutter et al. |
| 6,893,000 | B2 | 5/2005 | Rutter et al. |
| 7,487,951 | B2 | 2/2009 | Johnson |
| D607,090 | S | 12/2009 | Johnson |
| 7,628,299 | B2 | 12/2009 | Johnson |
| D618,763 | S | 6/2010 | Johnson |
| D641,832 | S | 7/2011 | Johnson |
| D661,785 | S | 6/2012 | Johnson |
| D661,786 | S | 6/2012 | Johnson |
| D661,787 | S | 6/2012 | Johnson |
| 8,196,621 | B2 | 6/2012 | Johnson |
| 2004/0232374 | A1 | 11/2004 | Rutter et al. |
| 2004/0256424 | A1 | 12/2004 | Johnson |
| 2008/0245817 | A1 | 10/2008 | Bellmore |

FOREIGN PATENT DOCUMENTS

| | | | |
|---|---|---|---|
| EP | 1772379 | A1 | 4/2007 |
| GB | 2339771 | A | 7/1998 |

* cited by examiner

SPOUT ASSEMBLY FOR A FLEXIBLE BAG

CROSS-REFERENCE TO RELATED APPLICATION

Not Applicable

BACKGROUND OF THE DISCLOSURE

1. Field of the Disclosure

The invention relates in general to flexible packaging, and more particularly, to a spout assembly for a flexible bag that is configured to interface with a plurality of different connectors commonly utilized in the dispensing of flowable material from such flexible bags.

2. Background Art

The use of flexible packaging is known in the art. Often the flexible packaging comprises a flexible bag having a spout assembly that is positioned within an outer rigid container (such as a box). The flexible bag includes a flowable material such as a liquid, a syrup, a juice, a gel or the like. The spout assembly is coupled to an adapter which is coupled to dispensing equipment. The flowable material is often withdrawn through the dispensing equipment by way of a vacuum or a pump or the like.

Any number of different types of adapters are known in the art. Problematically, it is desirable to utilize a single spout that is capable of coupling to a plurality of such adapters. In the case of threaded spouts, due to various issues such as vibration, creep and deformation, it is often the case that the connections can loosen over time and often while still in use.

SUMMARY OF THE DISCLOSURE

The disclosure is directed to a spout assembly for a flexible bag. The spout assembly includes a base flange, a body and a dual lead thread. The base flange has a top surface and a bottom surface opposite the top surface. At least one of the top surface and the bottom surface are configured for coupling to a flexible bag. The body extends from the base flange away from the top surface of the base flange. The body includes a proximal end corresponding to the base flange and a distal end spaced apart therefrom. The body includes an inner surface and an outer surface. The inner surface is placeable in fluid communication with a cavity of a flexible bag. The dual lead thread extends along the outer surface of the body between the proximal end and the distal end. The dual lead thread has a first threadform and a second threadform. The first threadform has a first threadform length. The second threadform has a second threadform length. The length of the first threadform is different than that of the second threadform.

In some configurations, the first threadform is longer than the second threadform.

In some configurations, the first threadform includes an upper portion and a lower portion and the second threadform includes an upper portion and a lower portion. Each upper portion and each lower portion has a length. The length of the upper portion of the first threadform is different than the length of the upper portion of the second threadform. Additionally, the length of the lower portion of the first threadform is different than the length of the lower portion of the second threadform.

In some configurations, the length of the upper portion of the first threadform is shorter than the length of the upper portion of the second threadform. Additionally, the length of the lower portion of the first threadform is longer than the length of the lower portion of the second threadform.

In some configurations, the upper portion of the first threadform and the second threadform each define an upper threadform thread diameter. Similarly, the lower portion of the first threadform and the lower portion of the second threadform define a lower threadform thread diameter. The upper threadform thread diameter is smaller than the lower threadform thread diameter.

In some configurations, the spout further includes an upper body flange spaced apart from the proximal end and the distal end extending about the body of the spout. The first threadform and the second threadform extend along the outer surface of the body between the distal end and the upper body flange.

In some configurations, the first threadform and the second threadform terminate at the upper body flange.

In some configurations, the upper body flange includes an outer surface, spaced apart from the body of the spout. The first threadform and the second threadform extend over at least a portion of the upper body flange.

In some configurations, the spout further comprises a lower body flange extending about the body of the spout. The lower body flange is spaced apart from the base flange and the upper body flange.

In some configurations, the base flange, the lower body flange and the upper body flange are substantially parallel to each other.

In some configurations, the spout further comprises an upper annular rim flange having an inner seat defining a diameter that is larger than a diameter of the body of the spout. An upstand wall extends away from the proximal end of the spout. An outwardly extending outer portion is positioned at a distal end thereof.

In some configurations, the spout assembly has an insert member slidably positionable within the spout.

In some configurations, the insert member includes a cylindrical body having an outer surface and an inner surface. The cylindrical body has an inner connector actuating assembly which includes a base web extending across the inner surface of the cylindrical body to cooperatively define a cavity. A connector engagement post extends from the base web toward a top end of the insert member, and spaced apart from the inner surface of the cylindrical body. A connector engagement rib extends between the connector engagement post and the inner surface of the cylindrical body. The engagement rib has an upper surface that is spaced apart from the base web. At least one transverse slot extends from the cavity through the cylindrical body near a bottom end of the cylindrical body.

In some configurations, the insert member further includes a plurality of flexible tabs that are hingedly coupled to a top end of the cylindrical body of the insert member. The flexible tabs are configured with a spout surface engageable with the spout and an inner coupling surface engageable with a connector insertable into the insert member. Upon insertion of the insert member into the spout, the flexible tabs are directed inwardly through interaction between the inner surface of the spout and the spout surface of the flexible tabs, to, in turn, be bias-able against the connector insertable into the insert member.

In some configurations, the spout further includes a lower spout inward lip positioned at the proximal end of the body. The insert member further includes a lower lip positioned at a bottom end of the outer surface of the cylindrical body. The lower spout inward lip and lower lip of the cylindrical body configured to sealingly engage upon positioning of the insert member into a proper orientation within the spout, to in turn, preclude the passage of a flowable material therethrough.

In some configurations, the cylindrical body further includes a plurality of transverse slots extending therethrough, with the transverse slots having a width that is greater than a height thereof, the plurality of transverse slots being positionable beyond the lower spout inward lip to be entirely in fluid communication with the cavity of the flexible bag.

In some configurations, a cap is releasably selectively coupled to the spout and the insert member.

In some configurations, the cap includes a body with an outer depending skirt and an inner depending skirt. The cap is configured to be coupled to the spout and the insert member in a first configuration upon partial insertion of the insert member within the spout, and in a second configuration upon full insertion of the insert member within the spout. In the first configuration, the outer skirt is configured to interact with the upper annular rim flange. In the second configuration, the flexible tabs engage the inner depending skirt to releasably retain the cap over the spout.

The first threadform and the second threadform are positioned so as to be approximately substantially 180° apart. Such a configuration enhances the initial coupling with the two threadforms, and provides a more positive engagement.

In some configurations, the bag comprises a pillow type bag having a plurality of panels that are sealed together to form a substantially fluid tight cavity. The spout assembly provides fluid communication therewith.

BRIEF DESCRIPTION OF THE DRAWINGS

The disclosure will now be described with reference to the drawings wherein.

DETAILED DESCRIPTION OF THE DISCLOSURE

Figure 1:
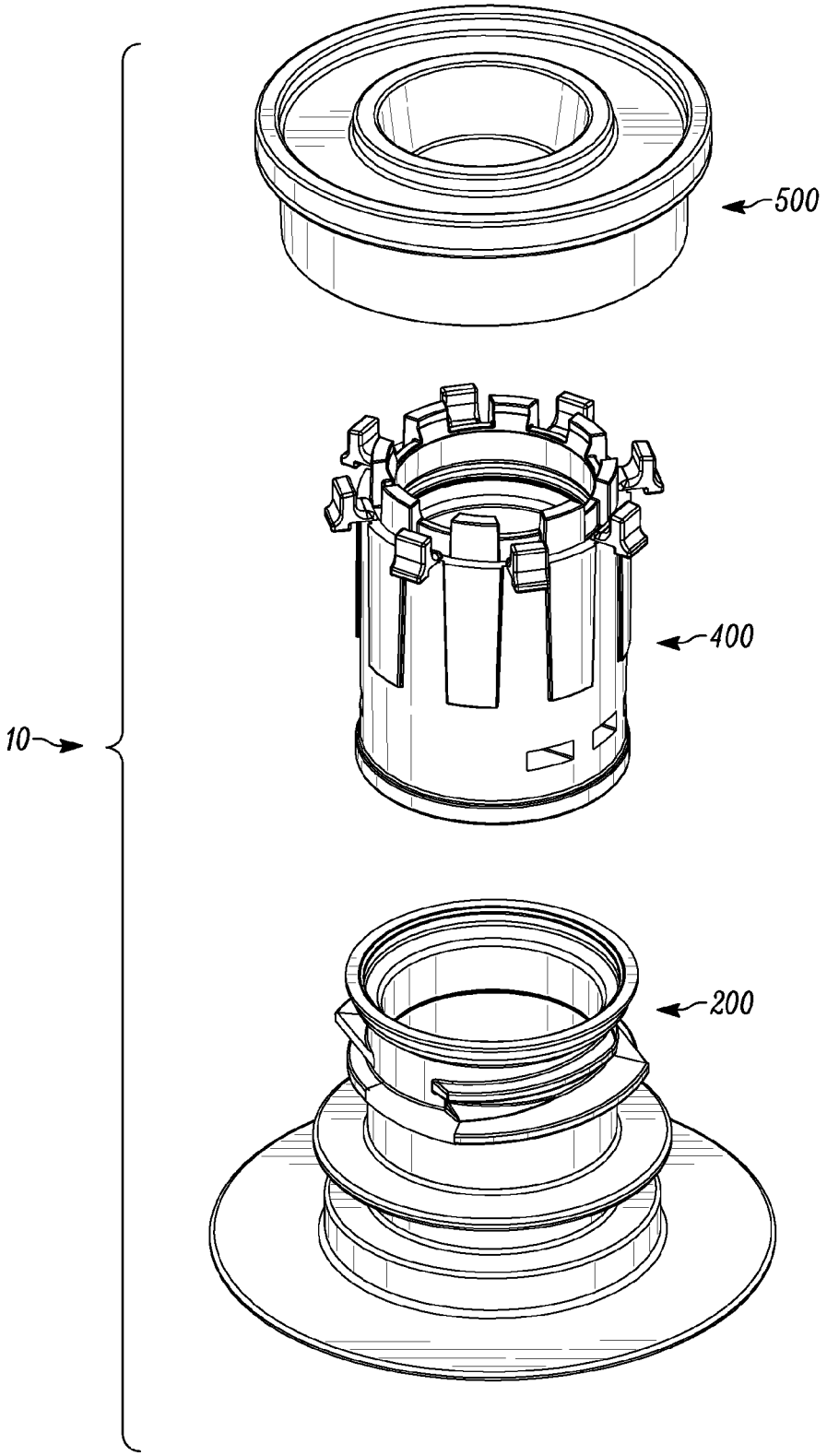
FIG. 1 of the drawings is an exploded view of the spout assembly, including the spout, the insert member and the cap thereof.
Figure 2:
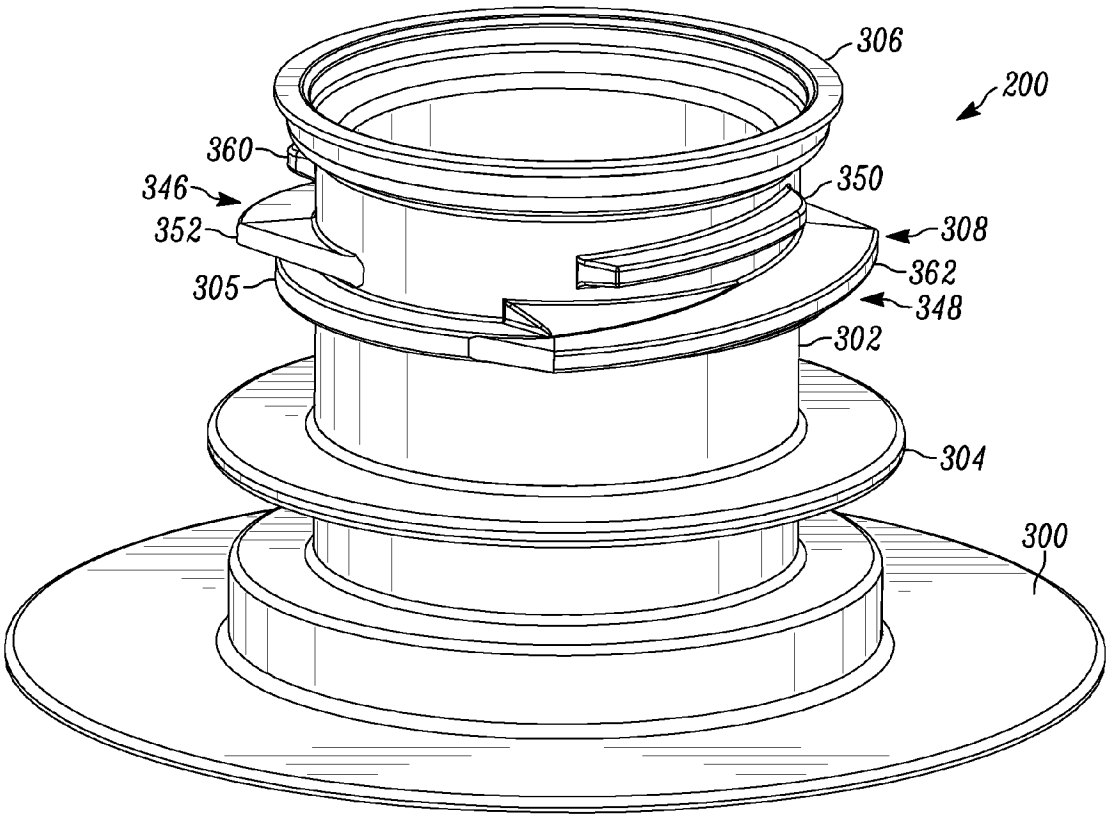
FIG. 2 of the drawings is a perspective view of the spout of the present disclosure.
Figure 3:
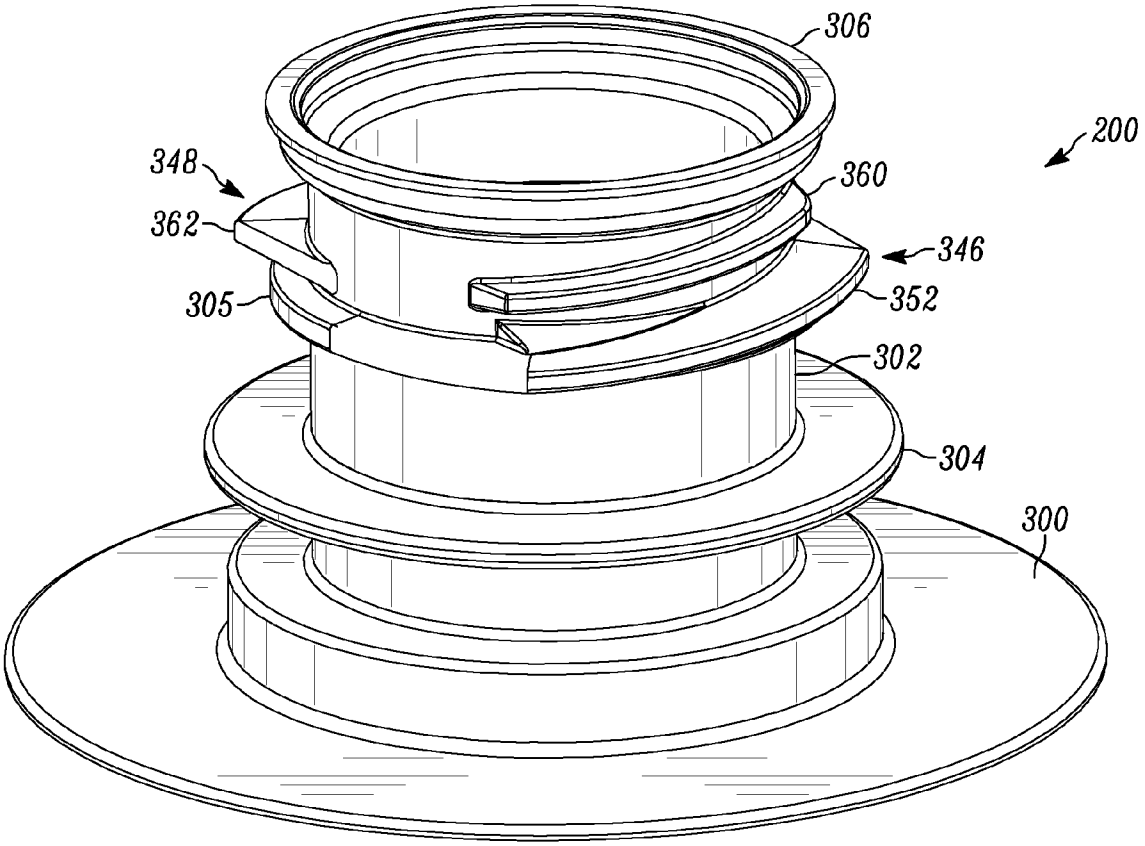
FIG. 3 of the drawings is a perspective view of the spout of the present disclosure, taken generally on the opposite side from that of FIG. 2.
Figure 4:
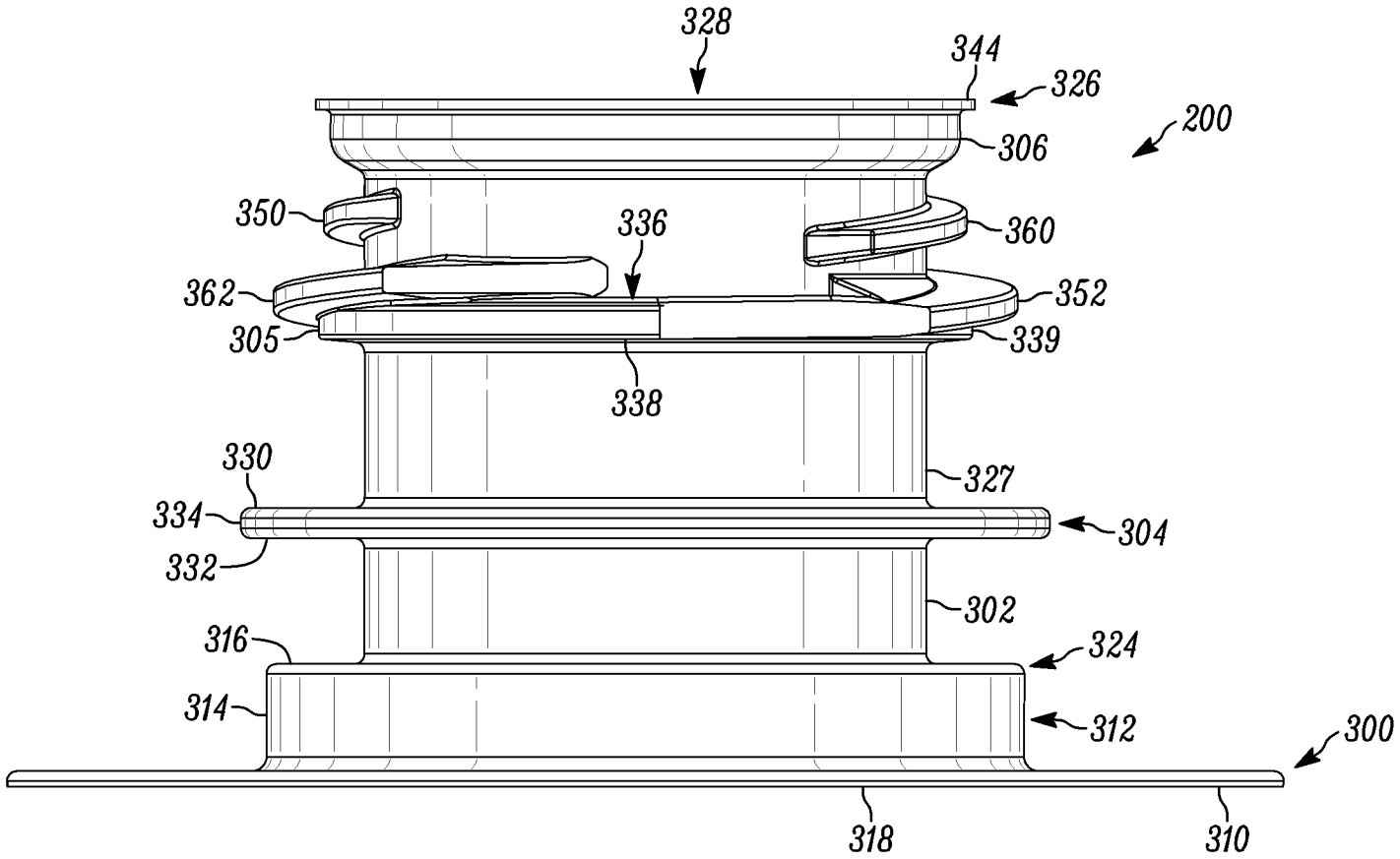
FIG. 4 of the drawings is a first side elevational view of the spout of the present disclosure.
Figure 5:
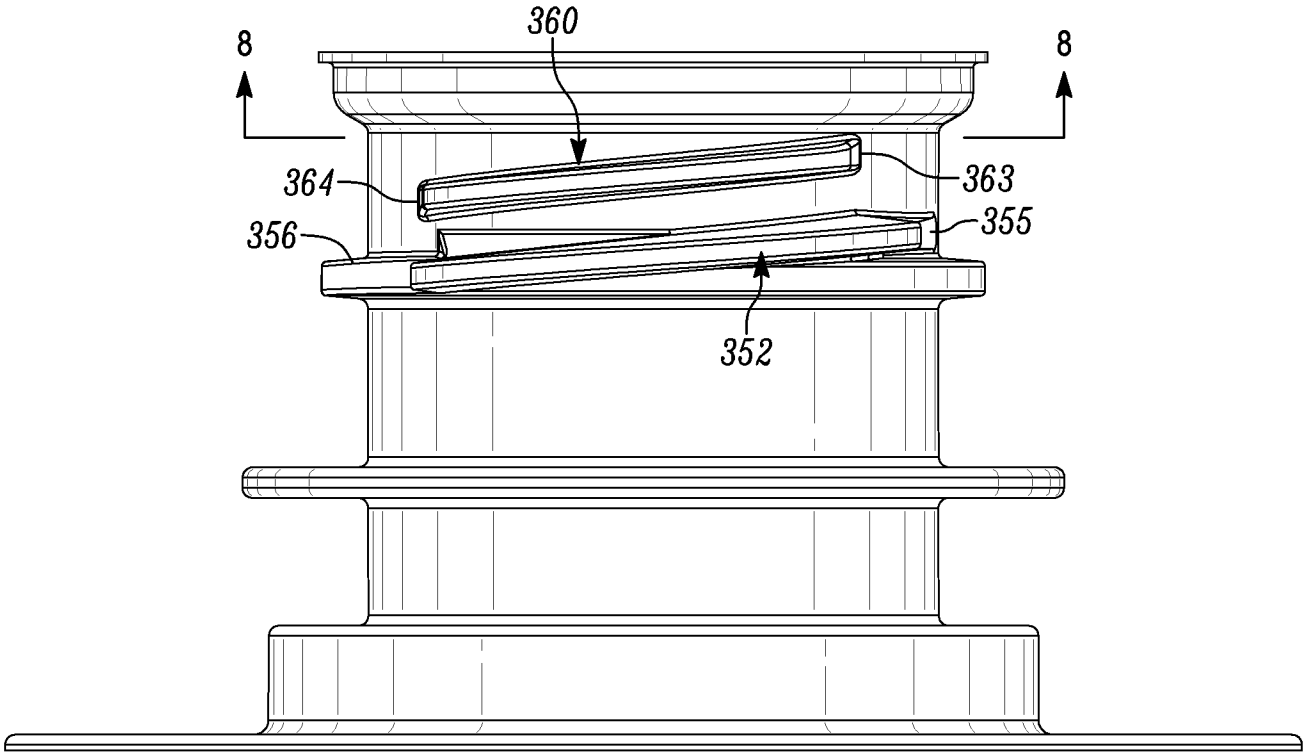
FIG. 5 of the drawings is a first end elevational view of the spout of the present disclosure, taken, generally one quarter turn from FIG. 4.
Figure 6:
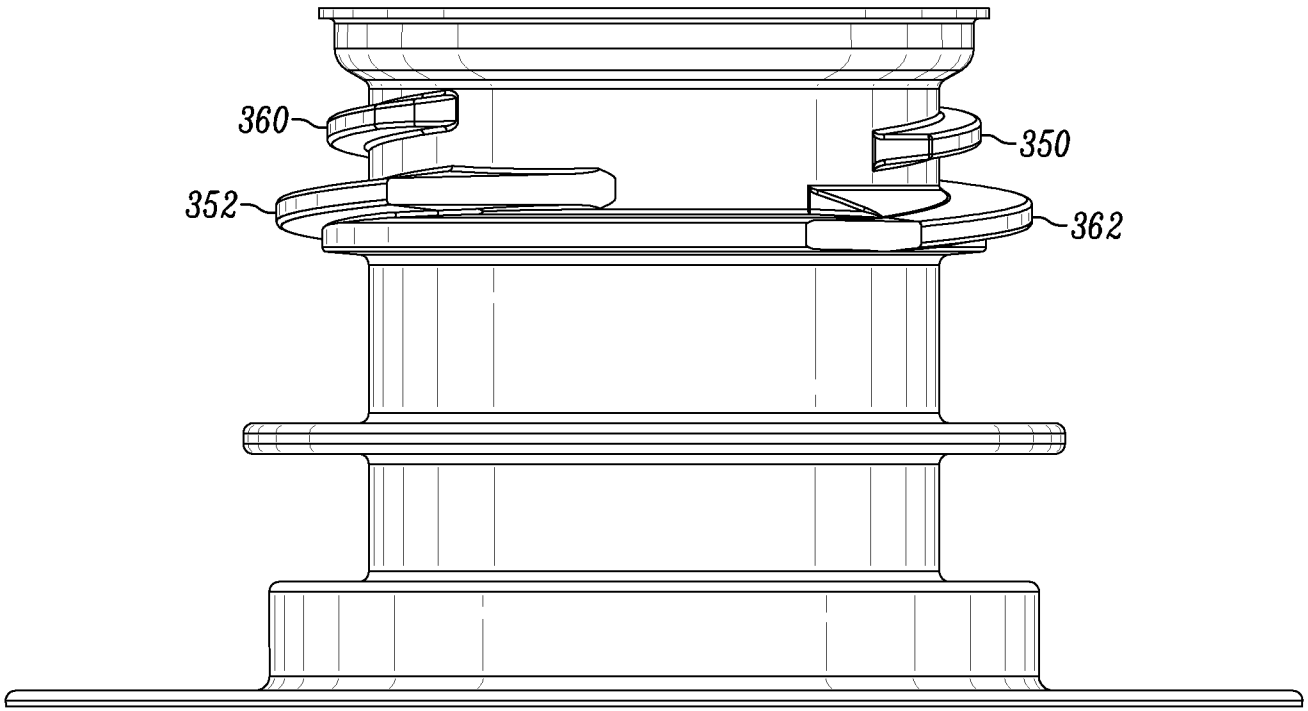
FIG. 6 of the drawings is a second side elevational view of the spout of the present disclosure, taken, generally one quarter turn from FIG. 5.
Figure 7:
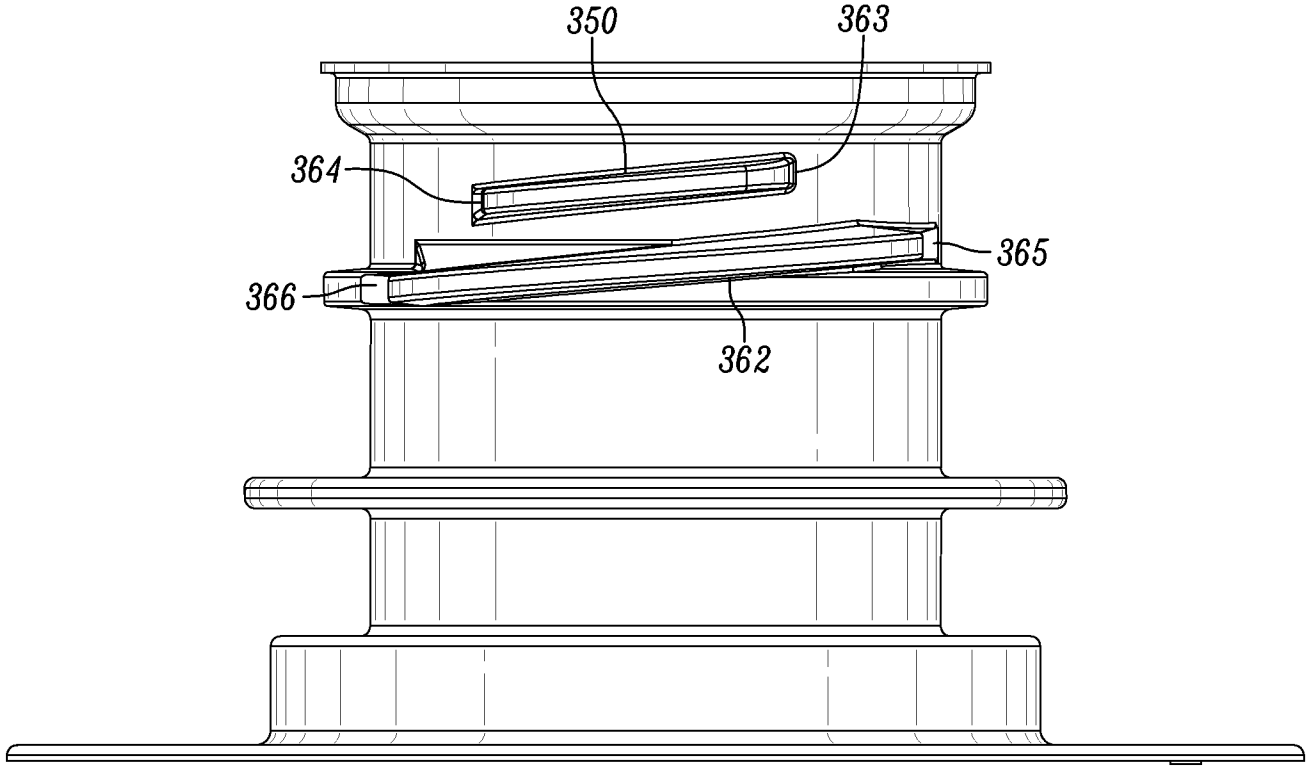
FIG. 7 of the drawings is a third side elevational view of the spout of the present disclosure, taken generally one quarter turn from FIG. 6.
Figure 8:
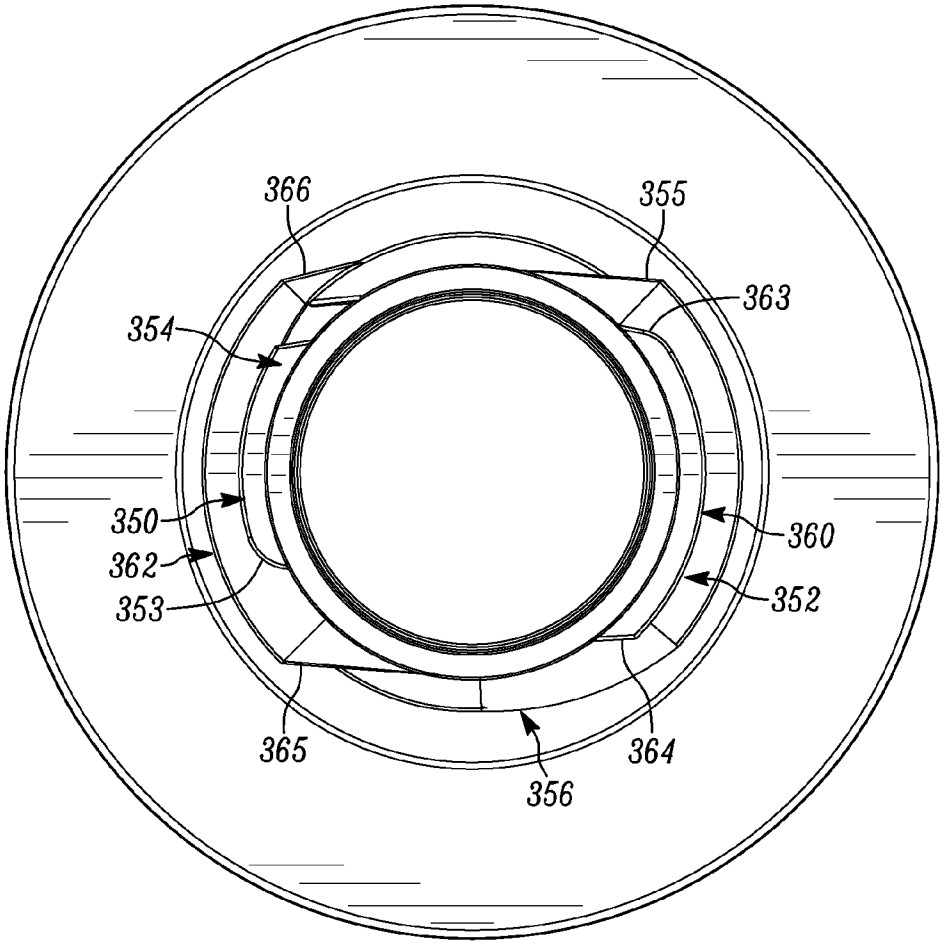
FIG. 8 of the drawings is a cross-sectional top view of the spout of the present disclosure, taken generally about lines 8-8 of FIG. 5.
Figure 9:
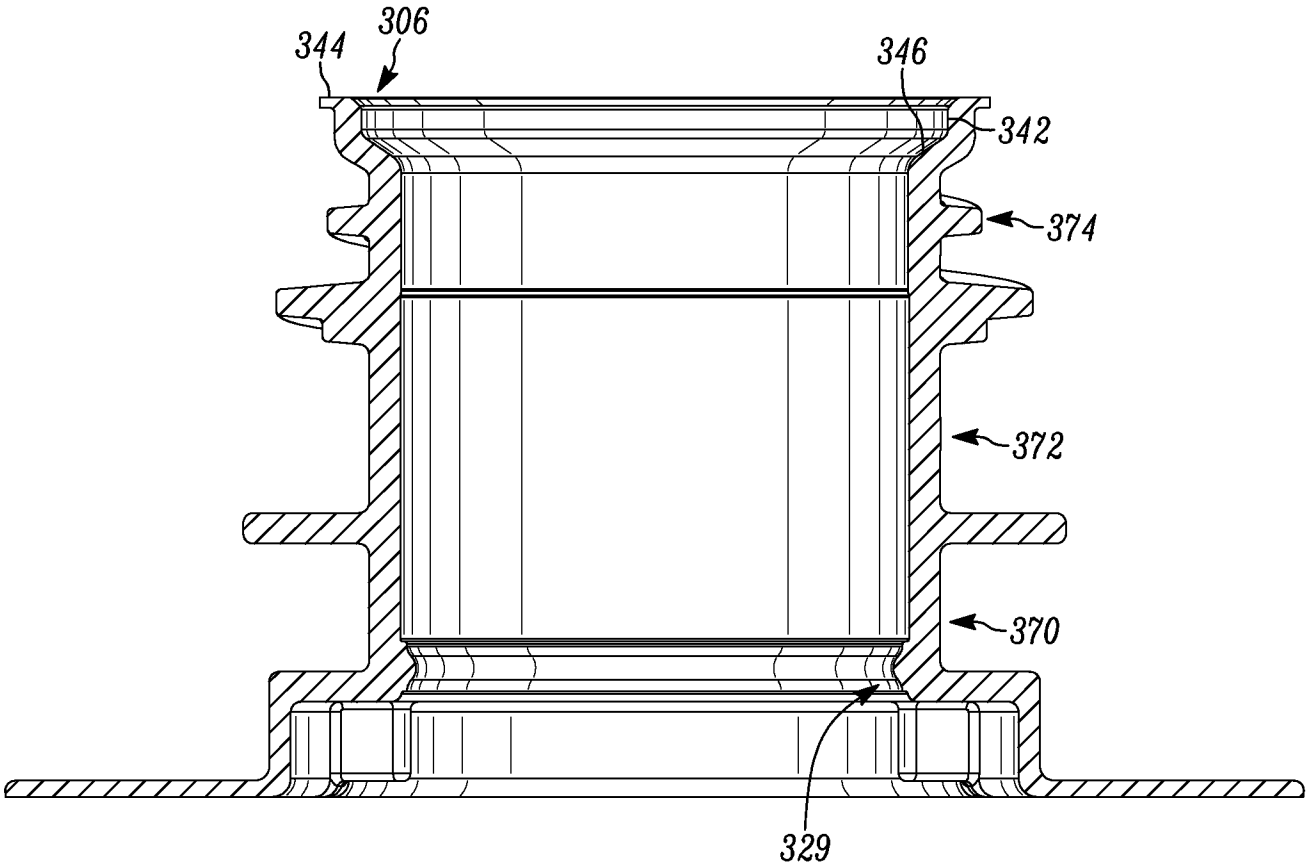
FIG. 9 of the drawings is a cross-sectional view of the spout of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 15:
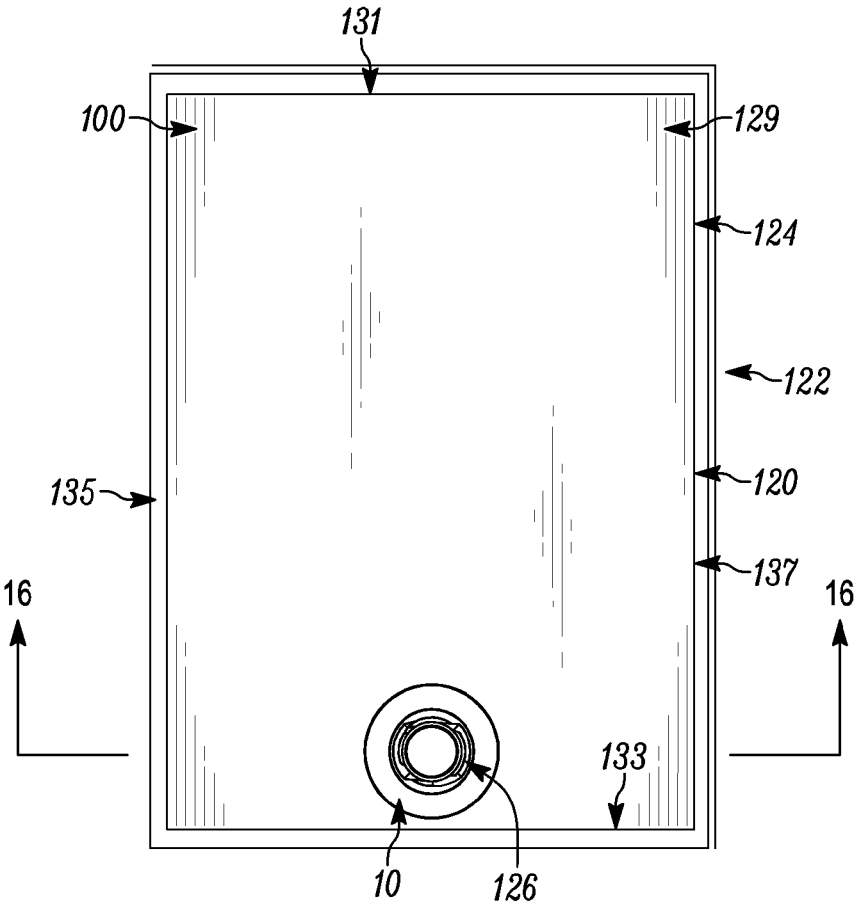
FIG. 15 of the drawings is a top plan view of a flexible bag having the spout assembly of the present disclosure.
Figure 16:
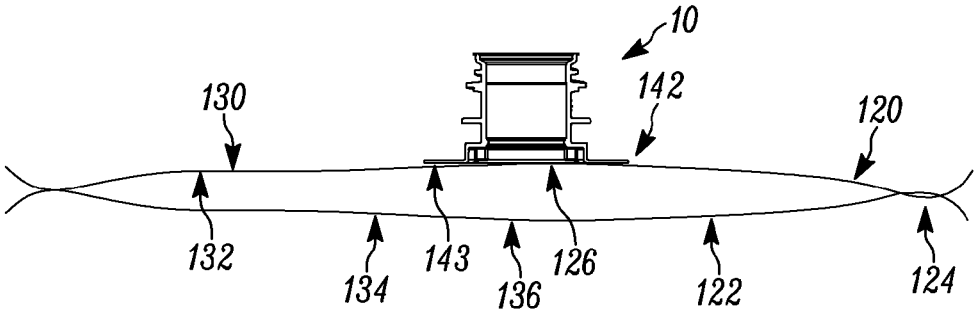
FIG. 16 of the drawings is a cross-sectional view of the flexible bag of the present disclosure, taken generally about lines 16-16 of FIG. 15.
Figure 18:
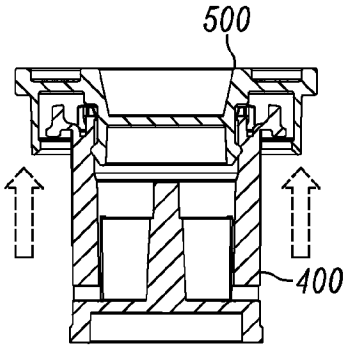
FIG. 18 of the drawings is a cross-sectional view of the assembled spout assembly as a filler decouples the cap and insert member as a single unit from the spout.
Figure 18:
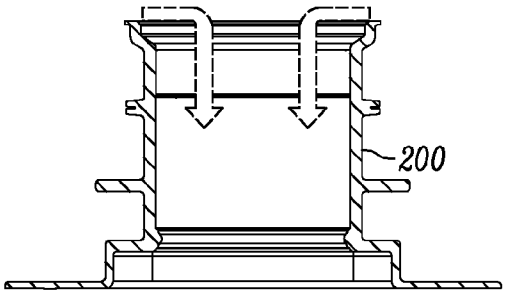

Referring now to the drawings and in particular to FIG. 1, a spout assembly of the present disclosure is shown generally at 10, and in FIGS. 15 and 16 in an environment coupled to a flexible bag 100. The flexible bag is often placed within a rigid outer container, often termed a bag-in-box package. Such packaging is often utilized for different flowable materials, such as, including, but not limited to, chemicals, detergents, drink syrups, mixes, purees, gels and the like. A dispenser coupling is provided typically which is coupled to the spout for purposes of dispensing the flowable material. The dispenser coupling is physically attached and detached from the spout. The present disclosure is directed to a spout that is configured to accept a coupling with a number of different types of dispenser couplings. In some cases, the dispenser coupling may comprise a screw on configuration, a clasping configuration or a snap configuration.

The flexible bag may comprise any number of different configurations and different materials. For example, and not limited thereto, the flexible bag 100 is shown in FIGS. 15 and 16 as comprising a pillow type bag formed from a single ply or multiple plies of polymer based film (which may be metallized or otherwise treated). Such a bag includes front panel 120 and back panel 122. Front panel 120 includes outer surface 130 and inner surface 132. The back panel 122 includes outer surface 134 and inner surface 136. The front and back panel are positioned in an overlying orientation so that the inner surfaces face each other. It will be understood that while a generally rectangular inner bag is shown, a bag of a different shape, such as a shape that mates with the cavity portion of the outer soft box may be utilized.

The panels are then coupled together by way of seals 124. In the case of a pillow type container, the seals 124 include a top seal 131, bottom seal 133, first side seal 135 and second side seal 137. The seals are generally perpendicular to adjacent seals and parallel to opposing seals to generally define a square or rectangular configuration, thereby defining a generally square or rectangular cavity 129. The seals may be formed through the application of heat, or through other procedures, including, but not limited to RF welding, ultrasonic welding, adhesive, among others. The disclosure is not limited to any particular manner of attachment of the panels.

For many pillow type containers, an opening 126 is provided through the front panel 120 proximate, but spaced apart from the bottom seal 133. A spout 200 can be coupled thereto in sealed engagement. In certain embodiments, multiple spouts may be provided, one, for example, for dispensing, and one for filling. In other embodiments, spouts may be positioned along the seals so as to extend between the panels. The film is configured for use in association with multiple configurations of spouts, as well as in embodiments that do not require spouts.

Spout assembly 10 is shown in FIG. 1 as comprising spout 200, insert member 400 and cap 500. The spout 200 is shown in more detail in FIGS. 2 through 9 as comprising base flange 300, cylindrical upstand 302, lower body flange 304, upper body flange 305, upper annular rim flange 306 and dual lead thread 308. The base flange 300 includes lower portion 310 and upper portion 312. The two portions define lower surface 318, top surface 316 and outer surface 314. As will be understood to those of skill in the art, the base flange is coupled to the container body (i.e., typically a conventional pillow-type container) through welding, adhesion or other system typically joining the upper surface to the inside of the panels. The cylindrical upstand 302 extends upwardly from the base flange 300, positioned at a proximal end 324 thereof, and extends generally orthogonal thereto toward distal end 326. Typically, the cylindrical upstand is substantially uniform in cross-section and the inner surface defines a passageway which provides fluid communication with the cavity of the container. An lower spout inward lip 329 is positioned at or near the proximal end of the body 302. As will be explained, the lower spout inward lip 329 is configured to cooperate with the insert member to maintain the insert member in a desired configuration. While termed cylindrical, elliptical as well as other shapes are contemplated.

The lower body flange 304 includes upper surface 330, lower surface 332 and outer surface 334. The lower body flange is spaced apart from the base flange and is generally parallel thereto. Thus, a generally uniform lower channel 370 is defined between the flanges. Filling equipment and dispensing coupling equipment may be configured to grasp the spout 200 about the geometry defined by the defined lower channel and the associated flanges. In the embodiment shown, the upper flange corresponds in diameter to the upper portion 312 of the base flange 300 with the outer surfaces of each being corresponding in configuration (that is, having the same foot print, for example). It will be understood that variations are contemplated.

The upper body flange 305 includes upper surface 336, lower surface 338 and outer surface 339. The upper body flange is spaced apart from the lower body flange and is generally parallel thereto. Thus, a generally uniform central channel 372 is defined between the upper body flange and the lower body flange. In addition, a generally uniform thread channel 374 is defined between the upper body flange and the upper annular rim flange 306. Equipment can utilize either of these channels for purposes of retention structures. The diameter of the upper body flange is less than the lower body flange, and, as will be explained, less than the dual lead helical thread 308.

The upper annular rim flange 306 extends about the distal end of the cylindrical upstand 302. In the embodiment shown, the upper annular rim flange 306 includes inner seat 340 with upstand wall 342 and outer portion 344. The inner seat 340 comprises a portion of enlarged diameter relative to the body 302 and provides a sealing surface that has an arcuate cross-sectional configuration together with the upstand wall 342 that extends upwardly therefrom. The outer portion 344 extends outwardly and provides a lip at the distal end of the upstand wall 342. As will be explained, the diameter of the upper lip is approximately the same as the upper portion of the first and second threadform.

The dual lead thread 308 is disposed between the upper annular rim flange 306 and the upper body flange 305. The dual lead thread 308 is preferably helically wound about the body 302 and includes first threadform 346 and second threadform 348. The first threadform 346 includes upper portion 350 and lower portion 352 which generally lie on the same helical winding (although it will be understood that the two portions may be slightly offset so as to be on slightly different helical windings). Generally, however, the two portions have the same pitch. The upper portion 350 includes first end 353 and second end 354 defining a length thereof. The diameter of the upper portion 350 is smaller than that of the lower portion 352, so that the upper portion diameter is similar to the upper annular rim flange 306, and smaller than the diameter of the upper body flange 305.

The lower portion 352 includes first end 355 and second end 356 defining a length. The lower portion is generally on the opposite side (that is about 180° away) from the upper portion 350, although variations are contemplated where the two structures are not entirely on opposite sides. The lower portion 352 extends approximately one quarter of a turn, although variations are contemplated. The second end 355 of the lower portion 352 generally coincides with the upper body flange 305 and terminates at or near the lower surface 338 of the upper body flange 305. In the embodiment shown, the lower portion 352 extends over the outside of the upper body flange 305.

Similarly, the second threadform 348 includes upper portion 360 and lower portion 362 which generally lie on the same helical winding (although it will be understood that the two portions may be slightly offset so as to be on slightly different helical windings). Generally, however, the two portions have the same pitch. The upper portion 360 includes first end 363 and second end 364 defining a length thereof. The diameter of the upper portion 360 is smaller than that of the lower portion 362, so that the upper portion diameter is similar to the upper annular rim flange, and smaller than the diameter of the upper body flange 305.

The lower portion 362 includes first end 365 and second end 366 defining a length. The lower portion is generally on the opposite side (that is about 180° away) from the upper portion 360, although variations are contemplated where the two structures are not entirely on opposites sides. The lower portion 362 extends approximately one quarter of a turn, although variations are contemplated. The second end 365 of the lower portion 362 generally coincides with the upper body flange 305 and terminates at or near the lower surface 338 of the upper body flange 305. In the embodiment shown, the lower portion 362 extends over the outside of the upper body flange 305.

The first threadform 346 and the second threadform 348 are positioned so as to be approximately 180° apart from each other (that is, generally corresponding to each other and on opposite sides of each other). The upper portion 350 of the first threadform 346 is longer than the upper portion 360 of the second threadform 348. To the contrary, the lower portion 352 of the first threadform 346 is shorter than the lower portion 362 of the second threadform 348. In other embodiments, the portions of the first threadform may both be longer than the corresponding portions of the second threadform. In still other embodiments, the portions of the first threadform may both be shorter than the corresponding portions of the second threadform. In yet another embodiment, the upper portions may be generally identical, with the lower portions having a longer or shorter relative configuration. In summary the first threadform is of a different length than the second threadform. That is, either or both of the upper portions and the lower portions may be of different lengths. It is possible that while each portion may be of a different length, the combined threadform lengths are the same. Such a configuration results in different lengths of the upper and lower portions, which is defined as being of different length.

Due to the different dispensing couplings in use, the threads are limited in size (i.e., length), as well as thread depth. As such, there is a chance that the connector can be loosened due to vibration or relaxation (i.e., due to creep or deformation). For example, vibrational loads will tend to loosen a fastener over time, and, for the limited thread engagement depth with different dispensing couplings, such loosening is problematic. Through relaxation of the components, pre-load holding force can be reduced. The configuration of the different length of the opposing threadform components positions the loads on the threads on different planes and locations on the opposing threads. Thus, if there is a decrease in the pre-load on one thread due to vibration or relaxation (or other forces or disturbances), while one of the threads may be affected, the other thread may maintain the pre-load holding force. This is because the opposite thread has a different geometry and load points are generally located at different points and different planes. One particular advantage is seen where the starting and ending points of the threads are at different points (that is, the corresponding portions of the threadforms have different lengths, with the possibility of both the first end and the second end not being directly opposing to each other). In the embodiment shown, the lower portions have first ends that are approximately 180° apart, with the second ends that are more than 180° apart. In other embodiments, both the first ends and the second ends of the lower portions of the threadforms may be spaced apart at a distance that are other than 180°. In the embodiment shown, the second end 366 of the lower portion 362 of the second threadform 348 is more than 180° (in a clockwise direction) from the second end 356 of the lower portion 352 of the first threadform 346.

It will be understood that in some embodiments, solely a lower portion of each of the first and second threadform may be present, and a flange may extend about the body at a location comparable to that of the upper portions of each of the first and second threadform. In other embodiments, the threadform may be continuous, that is, a single portion that extends about the entirety of the circumference of the body. In still other embodiments, the upper portions of each of the first and second threadform may be of different pitch than the corresponding lower portions.

Figure 10:
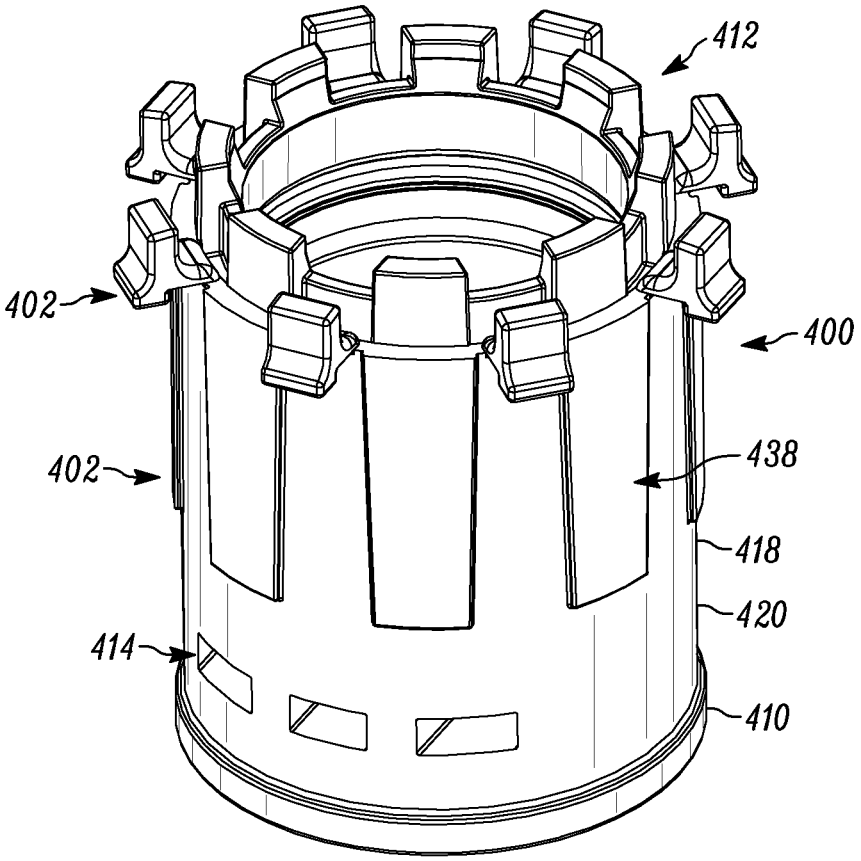
FIG. 10 of the drawings is a perspective view of the insert member of the spout assembly of the present disclosure.
Figure 11:
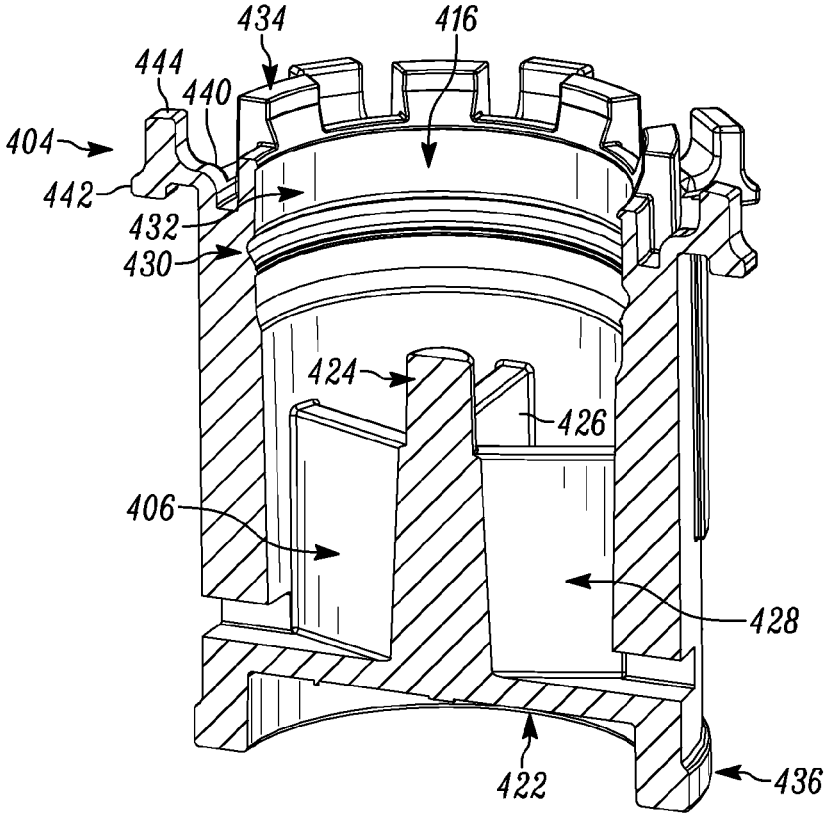
FIG. 11 of the drawings is a cross-sectional view of the insert member of the spout assembly of the present disclosure.
Figure 12:
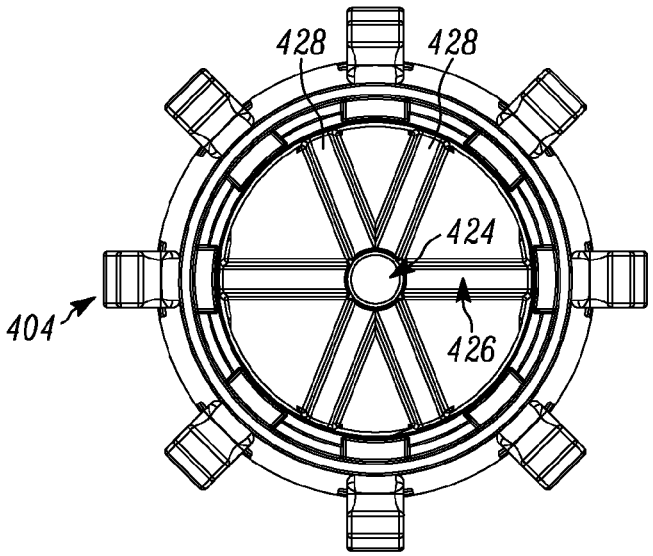
FIG. 12 of the drawings is a top plan view of the insert member of the spout assembly of the present disclosure.

The insert member 400 is shown in FIGS. 10, 11 and 12 as comprising cylindrical body 402, flexible tabs 404 and inner connector actuating assembly 406. The cylindrical body extends between bottom end 410 and top end 412. Additionally, the cylindrical body includes inner surface 416 and outer surface 420. As will be explained in more detail below, the cylindrical body is configured to slidably translate within the body 302 such that the outer surface 420 of the insert member, abuttingly engages (and, preferably, sealingly engages) the lower inward lip 329 of the body 302. It will be understood that despite the substantial sealing engagement between the components, slidable movement is provided therebetween, to selectively allow or stop the passage of fluid through the spout 200.

The inner surface 416 includes cap engagement undercut 430, connector seal surface 432 and connector seal engagement surface 434. As will be explained, the cap engagement undercut 430 provides for the receipt and retention of a tab on the cap. The connector seal surface provides a relatively smooth and continuous surface for sealing engagement between a connector and the inner surface 416 of the cylindrical body. The connector seal engagement surface 434 provides an initial engagement region that urges the seal (typically an o-ring) into the proper configuration and position for further downstream positioning on the connector seal surface 432.

The outer surface 418 includes lower lip 436 and axial boss 438. The lower lip 436 extends outwardly at or near the bottom end 410 of the cylindrical body 402. The lower lip 436 precludes the insert member from pulling out of the spout in the seated position, as will be described below.

Flexible tabs 404 are disposed about the top end 412 of the cylindrical body 402 and, in the resting position extend outwardly from the outer surface 418. In the embodiment shown, a total of eight flexible tabs are disposed generally uniformly about the outer perimeter of the cylindrical body. Each of the flexible tabs is substantially identical (although variations are contemplated), and each include hinge 440, spout surface 442 and inner coupling surface 444. As will be explained the flexible tabs are configured to rotate about hinge 440 wherein the flexible tabs can be urged inwardly by interaction between the spout and spout surface 442, whereupon inward urging directs the inner coupling surface of each of the flexible tabs between portions of the connector seal engagement surface 434, and into contact with either a cap or a connector, to provide a clamping force thereagainst.

The inner connector actuating assembly 406 is shown in FIG. 11 as comprising base web 422, connector engagement post 424, connector engagement ribs 426 and support member 428. The base web 422 extends across the cylindrical body so as to provide a substantially continuous surface thereacross, defining a cavity together with the cylindrical body. A plurality of transverse slots 414 extend through the cylindrical body providing fluid communication with the defined cavity. Along with the positioning of the lower inward lip 329 at or near the lowest point of the proximal end 324 of the body 302, the transverse openings 414 are configured as low profile openings (that is, of greater width than height) so that only a slight extension beyond the lower inward lip 329 exposes substantially the entirety of the transverse openings, and, a plurality of such openings (six in the present embodiment). It will be understood that with such a configuration and relationship between the openings and the position of the lower inward lip 329, additional assistance or urging into the opposite direction, by way of, for example, a spring or other biasing member is not needed. Connector engagement post 424 extends upwardly from the base web 422, and is generally centrally located. The connector engagement post terminates short of the top end 412 of the cylindrical body, and, in the embodiment shown, below the cap engagement undercut 430.

The connector engagement ribs 426 extend between the inner surface 416 of the cylindrical body and the connector engagement post 424. The connector engagement ribs 426 include an upper surface that is configured to engage a portion of the connector. The connector engagement post 424, in the embodiment shown, extends upwardly from the base web 422 and terminates below the connector engagement post. As such, and as will be explained, when the connector is inserted, the connector reaches the connector engagement post prior to reaching the connector engagement ribs. A plurality of additional support members 428 extend between the inner surface 416 of the cylindrical body and the connector engagement post.

Figure 13:
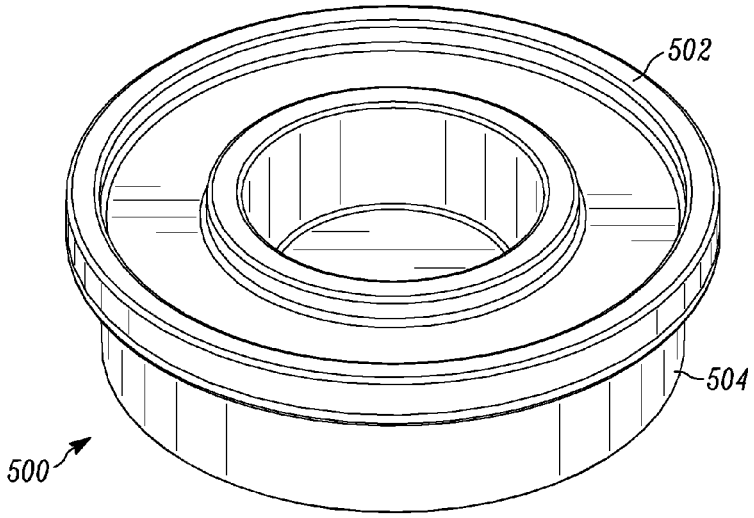
FIG. 13 of the drawings is a perspective view of the cap of the spout assembly of the present disclosure.
Figure 14:
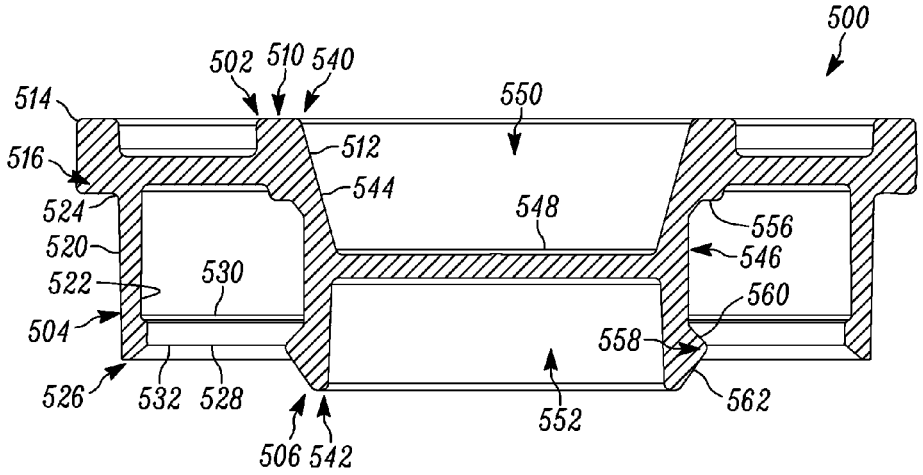
FIG. 14 of the drawings is a cross-sectional view of the cap of the spout assembly of the present disclosure.

The cap 500 is shown in FIGS. 13 and 14 as comprising body 502, outer depending skirt 504, inner depending skirt 506. Preferably, the cap 500 is a monolithic integrally molded polymer member. The body 502 includes top annular surface 510, inner perimeter 512 and outer perimeter 514. The outer depending skirt 504 extends annularly away from the body 502 spaced slightly inside of the outer perimeter 514 so as to define a flange 516 (which may be utilized to grasp and remove the cap 500).

The outer depending skirt 504 includes outer surface 520, inner surface 522, proximal end 524 and distal end 526. The outer depending skirt is generally orthogonal to the body 502, although variations are contemplated. At or near the distal end 526, the inner lip 528 is positioned to extend inwardly from the inner surface 522 of the outer depending skirt. The inner lip 528 includes inclined upper annular surface 530 and inclined lower annular surface 532. These surfaces tend to assist the engagement of the inner lip with the corresponding structure.

The inner depending skirt 506 is shown in FIG. 14 as comprising proximal end 540 and distal end 542, as well as inner surface 544 and outer surface 546. The inner surface 544 includes a dividing wall 548 that extends thereacross which divides the area into an upper cavity 550 and a lower cavity 552. The upper and lower cavities are separated from each other by the dividing wall. In other embodiments, the dividing wall may be coplanar with the top surface of the body, such that only a lower cavity is defined. In other embodiments, the dividing wall may extend beyond the top surface, in which case, again only a lower cavity is defined.

The outer surface 546 includes upper outward flange at the proximal end thereof. The upper outward flange provides a upper stop which interfaces with the top end of the cylindrical body 402 of the insert member 400. The lower outward lip 558 is positioned at or near the distal end 542 of the inner depending skirt. The lower outward lip extends outwardly toward the outer depending skirt and includes upper inclined surface 560 and lower inclined surface. The inclined surfaces assist the lip into and out of a corresponding structure on the inner surface of the cylindrical body, namely the cap engagement undercut 430.

As shown in FIG. 14, the outer depending skirt and the inner depending skirt, along with the body 502 cooperate to define a downwardly opening annular channel, which is configured to receive and engage the spout and the insert member therewithin. As will be explained below with respect to the operation, the cap can be coupled to the inner member and the spout in a number of different configurations depending on various factors, including, but not limited to whether the flexible bag is empty, or has been filled, whether a connector has been coupled or not, among others.

Figure 17:
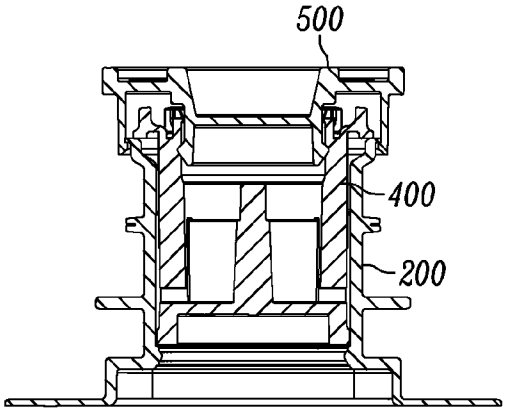
FIG. 17 of the drawings is a cross-sectional view of the assembled spout assembly as configured prior to the step of filling by a filler.

In operation, and with reference to FIGS. 17 through 25, and in particular initially to FIG. 17, a configuration of the spout, cap and the insert member is shown prior to filling of the flexible bag. It will be understood that in FIGS. 17 through 25, for purposes of clarity, many of the reference numbers below have not been included in these figures, and, reference is made to the FIGS. 1 through 17 for such reference numbers. The spout is attached to a flexible bag that is to be filled with flowable material. The initial position of the insert member is that the insert member is positioned in a first position, wherein the bottom end 410 of the cylindrical body of the insert member 400 is positioned above the lower spout inward lip 329 of the body of the spout 200. The cap is positioned over the spout, and the inner lip 528 of the distal end of the outer depending skirt 504 engages with the outer portion 344 of the upper annular rim flange 306 of the spout 200. At the same time, the inner depending skirt 506 extends into the cylindrical body of the insert member 400, and, the lower outward lip 558 engages the cap engagement undercut 430 of the insert member 400. To preclude further insertion of the inner depending skirt into the insert member, the upper outward flange 556 interfaces with (and provides a stop for) the top end 412 of the insert member 400. In such a configuration, the cap provides closure over the opening of the spout and provides protection by precluding the ingress of dust, fluid, microbes material or other unwanted constituents.

To fill the underlying bag with flowable material through the spout, the cap and the insert member are removed by the filler. In particular, and with reference to FIG. 18, the filler typically utilizes the flange 516 for purposes of disconnecting the cap and the spout. As the cap is engaged with the insert member, the removal of the cap also removes the insert member from within the body of the spout 200. Once removed, access to the spout is gained and the flexible bag can be filled through the spout with a flowable material.

Figure 19:
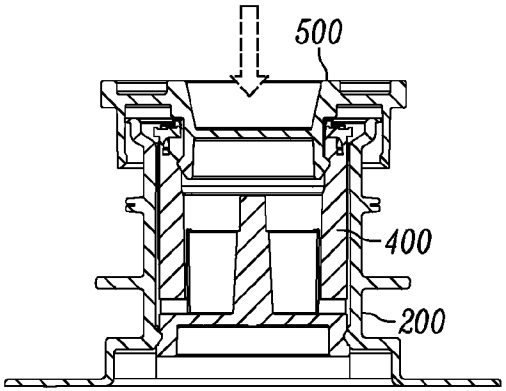
FIG. 19 of the drawings is a cross-sectional view of the assembled spout assembly after the step of filling by a filler.

With reference to FIG. 19, once the flexible bag is filled as desired, the cap can be returned over the spout, in a configuration that is different than the initial configuration. In the second configuration, the insert member 400 is coupled to the spout, such that the coupling therebetween is stronger than the coupling between the cap and the insert member. Therefore, in subsequent removals of the cap, the insert member will remain within the body 302 of the spout 200.

More particularly, as the insert member and the cap are placed within the body 302, continued insertive movement directs the bottom end 410 of the insert member into contact with the lower spout inward lip 329, and continued insertive movement passes the insert member beyond the lower spout inward lip until the lip engages the lower lip 436, precluding removal of the insert member from within the body of the spout. Such a configuration provides a seal, precluding the passage of flowable material from within the flexible bag through the spout.

At generally the same time, the flexible tabs 404 are caused to rotate about the hinge, urged by the interfacing of the spout surface and the inner seat 340 of the upper annular rim flange 306. The inward rotation of the flexible tabs 404 eventually directs the tabs toward and into the outer surface of the inner depending skirt 506 of the cap 500 so as to be positioned between the top end of the insert member and the upper outward flange 556. The filled flexible bag is ready for flowable material to be dispensed therefrom.

Figure 20:
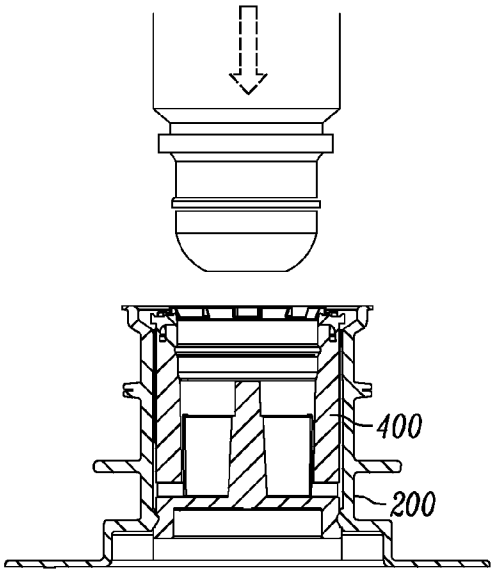
FIG. 20 of the drawings is a cross-sectional view of the spout assembly with the cap removed and the connector assembly being directed toward the insert member.

With reference to FIG. 20, to dispense flowable material from the spout, a connector is introduced. The connector includes both a central member which includes an outer sealing o-ring, and an inner valve plunger (not shown). A collar flange that is threadable onto the spout, or that can be clamped to the spout is coupled to the central member. Among other known connectors, connectors of the type that may be utilized with the present spout include, but are not limited to: the QCD II Connector and the QCD Encore Connector, both of which are available from LiquiBox Corporation of Worthington, Ohio, and, the PCS I Connector and the PCS II Connector, both of which are available from Rapak of Romeoville, Ill., as well as the connectors shown in U.S. Pat. Nos. 7,487,951; 6,637,725; 6,347,785; 8,196,621; and 7,628,299 each assigned to LiquiBox of Worthington, Ohio, and U.S. Pat. Nos. 5,983,964; 6,893,000; 6,72,337 and 6,612,545 issued to Rapak of Romeoville, Ill. Each of the foregoing is hereby incorporated by reference herein in its entirety.

It will be understood that the cap 500 is first removed. Once removed, the central member is inserted into the cylindrical body of the insert member. The sealing o-ring of the central member interfaces with the connector seal engagement surface 434 and is urged inwardly. Continued insertive movement directs the central member toward the inner connector actuating assembly, and the o-ring onto the connector seal surface 432.

Figure 22:
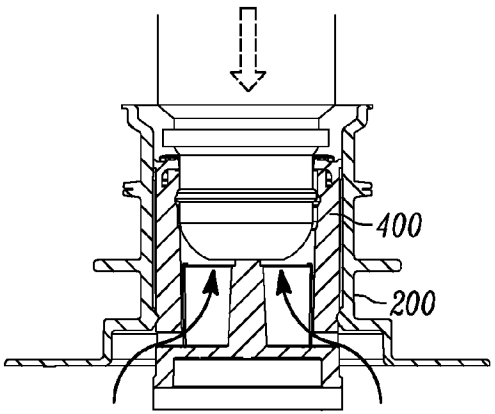
FIG. 22 of the drawings is a cross-sectional view of the spout assembly with the cap removed and the connector assembly fully inserted into the insert member, with displacement of the insert member into the dispensing configuration.
Figure 21:
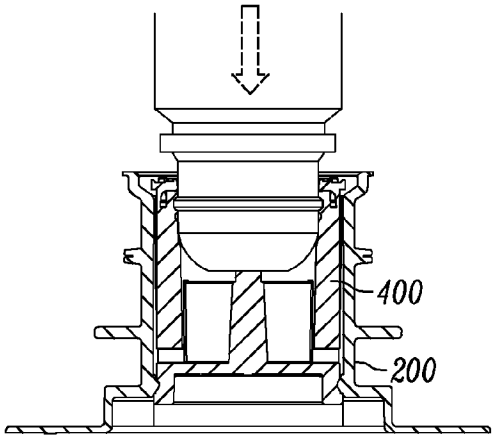
FIG. 21 of the drawings is a cross-sectional view of the spout assembly with the cap removed and the connector assembly being inserted into the insert member.

With reference to FIG. 21, as the connector reaches the inner connector actuating assembly, the connector engagement post 424 engages the central plunger while the connector engagement ribs preclude further relative insertive movement of the connector within the insert member. The central plunger is forced open by the connector engagement post. With reference to FIG. 22, once the end of travel has been reached, further insertive movement (which is achieved through further threading of the collar flange (or further clamping of the collar flange) directs the cooperative movement of the central member of the collar and the insert member relative to the spout such that the transverse openings 414 of the insert member 400 extend beyond the lower inward lip 329 so as to provide direct fluid communication between the central member and the flowable material, essentially positioning the insert member in a dispensing configuration. The further movement is limited by any one or more of the threads of the connector bottoming out, the connector contacts the lower body flange 304, the connector contacts the second threadform 348 and the insert axial boss 438 contacts the lower inward lip 329. The flowable material can then be withdrawn (through a vacuum suction pump, or though gravity, or through an external compressive force on the flexible bag, and in turn, flowable material).

As the insert member is driven further into the spout along with the central member, the spout surface 442 of the flexible tabs 404 comes into contact with the inner surface of the body 302 of the spout 200 beyond the inner seat, thereby imparting a clamping force through the inner coupling surface 444 of the flexible tab and the central member of the connector.

Figure 23:
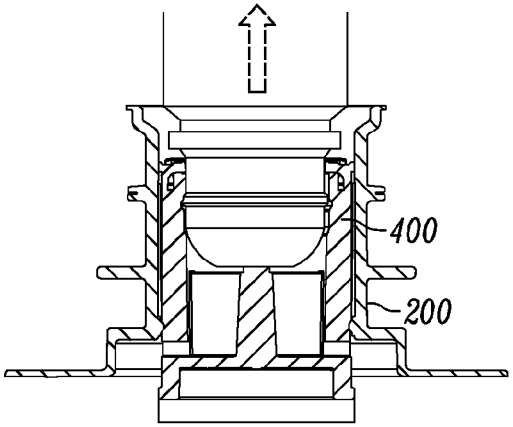
FIG. 23 of the drawings is a cross-sectional view of the spout assembly with the cap removed and the connector assembly being withdrawn from the spout together with movement of the insert member relative to the spout.
Figure 24:
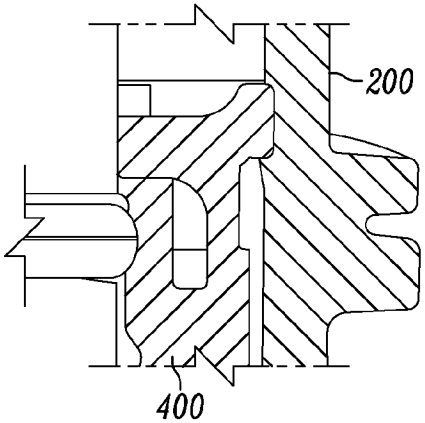
FIG. 24 of the drawings is an enlarged partial cross-sectional view of the spout assembly with the cap removed and the interface between the flexible tabs and the connector assembly.

With reference to FIG. 23, when the desired flowable material has been removed from within the flexible bag, the connector can be decoupled from the spout. More particularly, and with reference to FIG. 24, as the central member is withdrawn, the force by the flexible tabs against the connector and the top of the o-ring precludes relative movement of the central member and the insert member. As such, the removal of the central member directs the insert member to a closed orientation wherein the transverse slots 414 are positioned within the body and the insert member seals the spout from further passage of flowable material.

Figure 25:
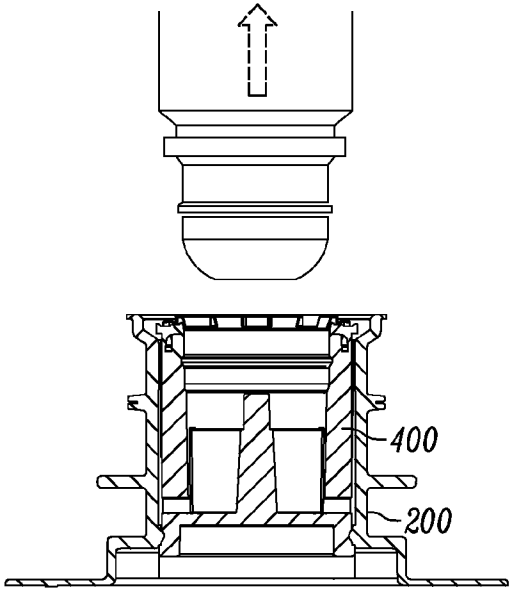
FIG. 25 of the drawings is a cross-sectional view of the spout assembly with the cap removed and the connector being fully removed from within the spout, with the insert member being returned to a closed or sealed configuration.

With reference to FIG. 25, as the insert member returns to the sealing configuration, the flexible tabs extend beyond the inner surface of the body and into the inner seat 340 wherein the force exerted on the central member from the flexible tabs is reduced so that further removal of the central member disconnects the central member from the insert member at which time the central member can be fully disconnected and removed, with the insert member in a sealing configuration within the spout.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A spout assembly for a flexible bag comprising:

a spout including:

a base flange having a top surface and a bottom surface opposite the top surface, at least one of the top surface and the bottom surface configured for coupling to a flexible bag;

a body extending from the base flange away from the top surface of the base flange, the body including a proximal end corresponding to the base flange, and a distal end spaced apart therefrom, the body including an inner surface and an outer surface, with the inner surface placeable in fluid communication with a cavity of a flexible bag; and a dual lead thread extending along the outer surface of the body between the proximal end and the distal end, the dual lead thread having a first threadform and a second threadform, the first threadform having a first threadform length, and the second threadform having a second threadform length, the length of the first threadform being different than that of the second threadform.

2. The spout assembly for a flexible bag of claim 1 wherein the first threadform is longer than the second threadform.

3. The spout assembly for a flexible bag of claim 1 wherein the first threadform includes an upper portion and a lower portion and the second threadform includes an upper portion and a lower portion, each upper portion and each lower portion having a length, wherein the length of the upper portion of the first threadform is different than the length of the upper portion of the second threadform, and wherein the length of the lower portion of the first threadform is different than the length of the lower portion of the second threadform.

4. The spout assembly for a flexible bag of claim 3 wherein the length of the upper portion of the first threadform is shorter than the length of the upper portion of the second threadform, and wherein the length of the lower portion of the first threadform is longer than the length of the lower portion of the second threadform.

5. The spout assembly for a flexible bag of claim 4, wherein the upper portion of the first threadform and the second threadform each define an upper threadform thread diameter and wherein the lower portion of the first threadform and the lower portion of the second threadform define a lower threadform thread diameter, wherein the upper threadform thread diameter is smaller than the lower threadform thread diameter.

6. The spout assembly for a flexible bag of claim 1 wherein the spout further includes an upper body flange spaced apart from the proximal end and the distal end extending about the body of the spout, with the first threadform and the second threadform extending along the outer surface of the body between the distal end and the upper body flange.

7. The spout assembly for a flexible bag of claim 6 wherein the first threadform and the second threadform terminate at the upper body flange.

8. The spout assembly for a flexible bag of claim 7 wherein the upper body flange includes an outer surface, spaced apart from the body of the spout, the first threadform and the second threadform extending over at least a portion of the upper body flange.

9. The spout assembly for a flexible bag of claim 6 wherein the spout further comprises a lower body flange extending about the body of the spout, the lower body flange being spaced apart from the base flange and the upper body flange.

10. The spout assembly for a flexible bag of claim 9 wherein the base flange, the lower body flange and the upper body flange are substantially parallel to each other.

11. The spout assembly for a flexible bag of claim 9 wherein the spout further comprises an upper annular rim flange having an inner seat defining a diameter that is larger than a diameter of the body of the spout, an upstand wall extending away from the proximal end of the spout, and an outwardly extending outer portion at a distal end thereof.

12. The spout assembly for a flexible bag of claim 11 further comprising an insert member slidably positionable within the spout.

13. The spout assembly for a flexible bag of claim 12 wherein the insert member includes a cylindrical body having an outer surface and an inner surface, the cylindrical body has an inner connector actuating assembly which includes a base web extending across the inner surface of the cylindrical body to cooperatively define a cavity, a connector engagement post extending from the base web toward a top end of the insert member, and spaced apart from the inner surface of the cylindrical body and a connector engagement rib extending between the connector engagement post and the inner surface of the cylindrical body and having an upper surface that is spaced apart from the base web, and at least one transverse slot extending from the cavity through the cylindrical body near a bottom end of the cylindrical body.

14. The spout assembly for a flexible bag of claim 13 wherein the insert member further includes a plurality of flexible tabs that are hingedly coupled to a top end of the cylindrical body of the insert member, the flexible tabs configured with a spout surface engageable with the spout and an inner coupling surface engageable with a connector insertable into the insert member, wherein upon insertion of the insert member into the spout, the flexible tabs are directed inwardly through interaction between the inner surface of the spout and the spout surface of the flexible tabs, to, in turn, be bias-able against the connector insertable into the insert member.

15. The spout assembly for a flexible bag of claim 14 wherein the spout further includes a lower spout inward lip positioned at the proximal end of the body, and the insert member further includes a lower lip positioned at a bottom end of the outer surface of the cylindrical body, with the lower spout inward lip and lower lip of the cylindrical body configured to sealingly engage upon positioning of the insert member into a proper orientation within the spout, to in turn, preclude the passage of a flowable material therethrough.

16. The spout assembly for a flexible bag of claim 15 wherein the cylindrical body further includes a plurality of transverse slots extending therethrough, with the transverse slots having a width that is greater than a height thereof, the plurality of transverse slots being positionable beyond the lower spout inward lip to be entirely in fluid communication with the cavity of the flexible bag.

17. The spout assembly for a flexible bag of claim 15 further comprising a cap that is releasably selectively coupled to the spout and the insert member.

18. The spout assembly for a flexible bag of claim 17 wherein the cap includes a body with an outer depending skirt and an inner depending skirt, the cap configured to be coupled to the spout and the insert member in a first configuration upon partial insertion of the insert member within the spout, and in a second configuration upon full insertion of the insert member within the spout, in the first configuration, the outer skirt configured to interact with the upper annular rim flange, and in the second configuration, the flexible tabs engaging the inner depending skirt to releasably retain the cap over the spout.

19. The spout assembly for a flexible bag of claim 1 wherein the first threadform and the second threadform are positioned so as to be approximately substantially 180° apart.

20. The spout assembly for a flexible bag of claim 19 wherein the bag comprises a pillow type bag having a plurality of panels that are sealed together to form a substantially fluid tight cavity, with the spout assembly providing fluid communication therewith.

* * * * *